US009003995B2

(12) United States Patent
Kang et al.

(10) Patent No.: US 9,003,995 B2
(45) Date of Patent: Apr. 14, 2015

(54) FLOATING OFFSHORE STRUCTURE

(75) Inventors: Hi-Seok Kang, Seongnam-si (KR); Hee-Chang Kim, Seoul (KR); Se-Eun Kim, Daejeon (KR); Sam-Kwon Hong, Daejeon (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 0 days.

(21) Appl. No.: 13/219,325

(22) Filed: Aug. 26, 2011

(65) Prior Publication Data

US 2011/0308444 A1 Dec. 22, 2011

Related U.S. Application Data

(63) Continuation of application No. PCT/KR2010/002637, filed on Apr. 27, 2010.

(30) Foreign Application Priority Data

Apr. 29, 2009 (KR) ..... 10-2009-0037758

(51) Int. Cl.
*B63B 35/44* (2006.01)
*B63B 43/06* (2006.01)

(52) U.S. Cl.
CPC ..... *B63B 43/06* (2013.01); *B63B 35/44* (2013.01)

(58) Field of Classification Search
CPC ..... B63B 35/44; B63B 9/065
USPC ..... 114/74 R, 264–266, 125, 121, 122
See application file for complete search history.

(56) References Cited

U.S. PATENT DOCUMENTS

| | | | | |
|---|---|---|---|---|
| 4,048,943 | A | 9/1977 | Gerwick, Jr. | |
| 4,108,102 | A | 8/1978 | Lindstrom | |
| 4,639,167 | A | 1/1987 | Petty et al. | |
| 6,761,508 | B1 | 7/2004 | Haun | |
| 7,413,384 | B2 * | 8/2008 | Horton et al. | 405/224.2 |
| 2006/0260526 | A1 * | 11/2006 | Kristensen et al. | 114/264 |
| 2009/0126616 | A1 | 5/2009 | Srinivasan | |
| 2012/0298027 | A1 * | 11/2012 | Srinivasan | 114/121 |

FOREIGN PATENT DOCUMENTS

| | | |
|---|---|---|
| FR | 2403931 | 4/1979 |
| JP | 2004-175137 | 6/2004 |
| JP | 2008-74297 | 4/2008 |
| JP | 2008-074297 | 4/2008 |

OTHER PUBLICATIONS

JP Office Action dated Oct. 9, 2012, pp. 1-2.
Extended European Search Report dated Jul. 5, 2013 for related application 10769922.5-1754, pp. 1-7.
Chinese Office Action for Patent Application No. 201080008838.5, including an English translation dated Jun. 26, 2013.

* cited by examiner

*Primary Examiner* — S. Joseph Morano
*Assistant Examiner* — Andrew Polay
(74) *Attorney, Agent, or Firm* — Brinks Gilson & Lione

(57) ABSTRACT

A floating offshore structure is disclosed. The floating offshore structure, which is for drilling or production, includes a semi-submerged platform body in the shape of a cylinder that is extended vertically above and below the sea level. The platform body is formed with a concave part that reduces its cross-sectional area. The concave part is discontinuously formed along an external circumferential surface of the platform body. The depth of submergence of the platform body is adjusted so that the water line is located at the concave part in an extreme marine condition.

8 Claims, 5 Drawing Sheets

FLOATING OFFSHORE STRUCTURE

RELATED APPLICATIONS

This application is a Continuation of International Application No. PCT/KR2010/002637, filed Apr. 27, 2010, which claims the benefit of Korean Application Number KR 10-2009-0037758, filed on Apr. 29, 2009. The disclosures of the above applications are incorporated herein by reference.

TECHNICAL FIELD

The present invention is related to a floating offshore structure, more specifically to a floating offshore structure configured to avoid vertical resonance caused by waves.

BACKGROUND

Floating offshore structures, which are used for drilling or production while being floated on the sea, demonstrate movements, such as rolling, pitching and heaving, by waves, winds and tides. Accordingly, it is important to minimize these movements in order to maximize the efficiency of a floating drilling/production facility.

Proposed recently as a floating structure for production are a structure such as a spar or a buoy, whose height is substantially greater than its diameter, and a structure proposed by SEVAN that has a substantially greater diameter than its height. These structures have various shapes, including cylindrical shapes, rectangular shapes and octagonal shapes, and aim to achieve stability through a center of mass that is lower than a center of buoyancy of the submerged structure.

Unlike a ship, the floating offshore structures such as the spar and the buoy, which have a substantially greater height than the diameter, are designed with an ideal shape having a small water plane area in order to minimize the rolling, pitching and heaving. However, these offshore structures have an elongated shape, which is difficult to make, transport and install, and cannot include a storage function.

In the meantime, in order to complement the spar or the buoy with the storage function, a cylinder-shaped floating offshore structure having a greater diameter than its height (hereinafter, "SEVAN-type offshore structure") is proposed. As the SEVAN-type offshore structure has the shape of a cylinder, rolling and pitching are dramatically reduced.

However, in terms of dealing with heaving of the SEVAN-type offshore structure, the diameter of the cylindrical structure becomes greater as the storage capacity increases, resulting in the increase in the water plane area.

Accordingly, the natural period of heaving of the SEVAN-type offshore structure becomes shorter and demonstrates a tendency to be close to a wave period in an extreme wave condition with a repetition period of 100 or more years that is generated by a typhoon or abnormal weather. When the natural period of the SEVAN-type offshore structure becomes close to the wave period, a phenomenon of resonance occurs, causing an excessive heaving movement.

Moreover, in order to prevent such an excessive heaving movement, an excessive mooring system is required to stabilize the SEVAN-type offshore structure, but the SEVAN-type offshore structure becomes inoperable if the heaving movement exceeds the designed value of the mooring system.

In the meantime, the conventional ship-type of offshore structure includes a plurality of cargo tanks and ballast tanks for storing the produced resources. In such a case, each tank is installed with a submerged pump. Not only is the submerged pump an expensive equipment, but an excessive costs are required because each tanks needs to be equipped with one submerged pump.

BRIEF SUMMARY

Contrived to solve the above problems, the present invention provides a floating offshore structure that is configured to reduce heaving significantly in an extreme marine condition.

Contrived to solve the above problems, an aspect of the present invention features a floating offshore structure used for drilling or production, which includes a semi-submerged platform body in a cylindrical shape that is extended vertically above and below a sea level. A concave part, which reducing a cross-sectional area of the platform body, is formed in the platform body. The concave part is discontinuously formed along an external circumferential surface of the platform body, and a depth of submergence of the platform body is adjusted in such a way that a water line is located at the concave part in an extreme marine condition.

A convex part, which is defined by adjacent concave parts, can be formed on the external circumferential surface of the platform body on which the concave part is formed.

The platform body can include a plurality of ballast tanks radially disposed on a side and a bottom of the platform body, and the concave part and the convex part can lobe formed on each ballast tank, and the each ballast tank can have a space that can connect an upper part and a lower part of the ballast tank in a straight line by the convex part.

The convex part can be successively disposed with the ballast tank that is adjacent.

The platform body can include a plurality of cargo tanks that are radially disposed, and a center part, which is vertically extended, can be formed in the platform body, and a ballast pump for pumping water inside the ballast tank and a cargo pump for pumping cargo material inside the cargo tank can be disposed in a lower portion of the center part.

The platform body can include a lower ballast tank disposed on a lower side of the center part, and a step height can be formed between the lower ballast tank and the each ballast tank so that the ballast pump and the cargo pump located above the lower ballast tank can be disposed adjacent to a lower portion of the each ballast tank and to a bottom floor of the cargo tank.

The platform body can include an expanded part formed to increase a cross-sectional area from a load line of the floating offshore structure to an upper end of the platform body.

The expanded part can form an angle of 30 degrees with a center line of the platform body.

By forming the concave part that reduces the cross-sectional area of the platform body and locating the water line of the floating offshore structure at the concave part in an extreme marine condition, the present invention can increase the natural period of heaving of the structure, allowing the floating offshore structure to avoid vertical resonance caused by extreme waves.

Moreover, by forming the convex part on each ballast tank, each ballast tank can have a space that connect the upper part and the lower part of each ballast tank in a straight line by the convex part, thereby meeting the requirement of the SOLAS convention.

Furthermore, by disposing the ballast pump and the cargo pump in a lower portion of the center part of the platform body, the length of pipes for connecting the pump and the tank can be minimized, thereby maximizing the utilization of the space. In addition, the number of the pumps can be appropriately adjusted, thereby saving the costs.

DETAILED DESCRIPTION OF THE DRAWINGS AND THE PRESENTLY PREFERRED EMBODIMENTS

Figure 1:
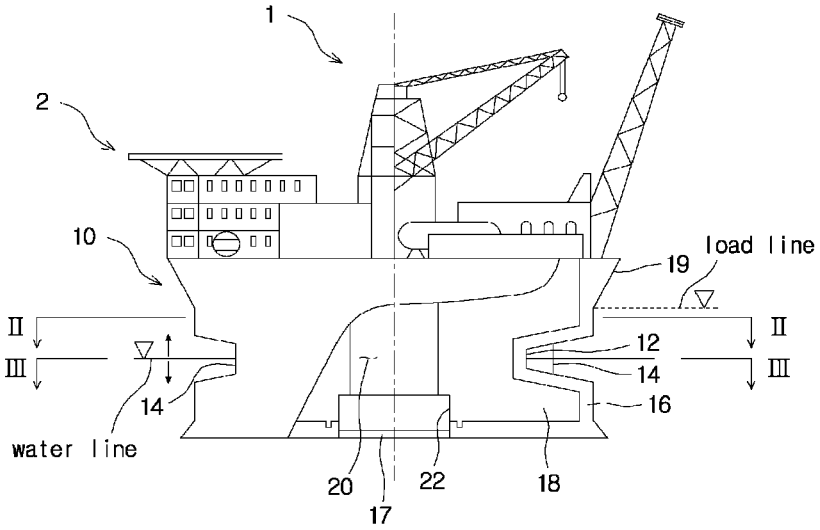
FIG. 1 is a cross-sectional view briefly showing a portion of a floating offshore structure in accordance with an embodiment of the present invention.

Hereinafter, a certain embodiment of the present invention will be described with reference to the accompanying drawings, and any identical or corresponding elements will be given the same reference numeral, and description of these identical or corresponding elements will not be redundantly provided.

Figure 2:
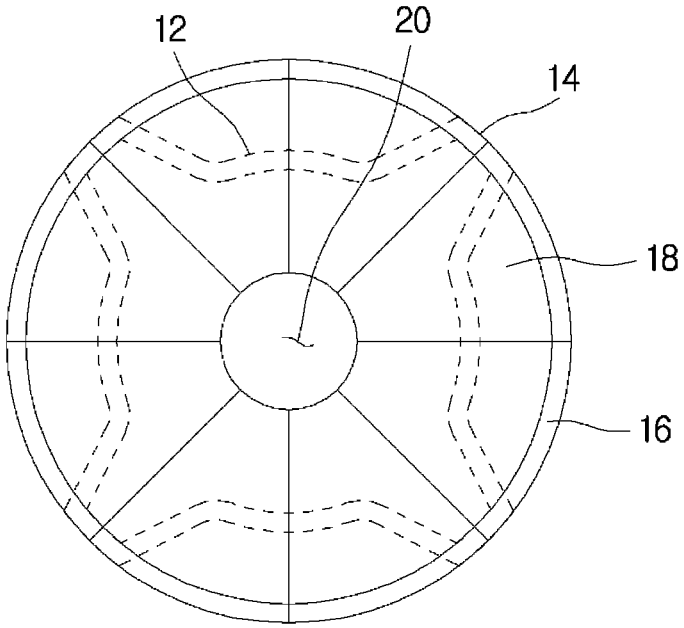
FIG. 2 is a cross-sectional view of FIG. 1 seen along the line II-II.
Figure 3:
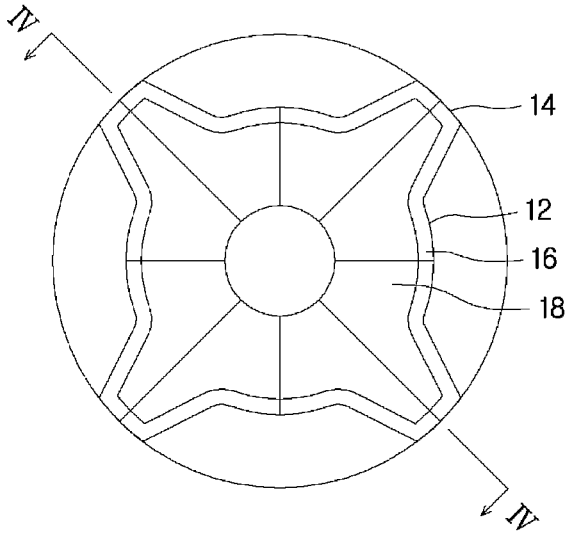
FIG. 3 is a cross-sectional view of FIG. 1 seen along the line III-III.
Figure 4:
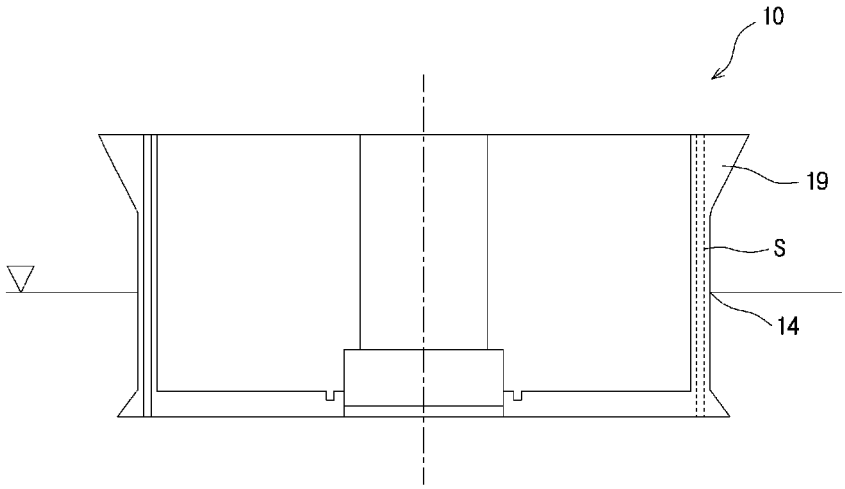
FIG. 4 is a cross-sectional view of FIG. 3 seen along the line IV-IV.

FIG. 1 is a cross-sectional view briefly showing a portion of a floating offshore structure in accordance with an embodiment of the present invention, and FIG. 2 is a cross-sectional view of FIG. 1 seen along the line II-II, FIG. 3 a cross-sectional view of FIG. 1 seen along the line III-III, and FIG. 4 a cross-sectional view of FIG. 3 seen along the line IV-IV.

Referring to FIG. 1, a floating offshore structure 1 in accordance with the present embodiment is for drilling or producing natural resources, such as oil and natural gas, and includes a platform body 10. Here, the drilled or produced natural resources are not limited to oil and natural gas but include all natural resources consisting of hydrocarbon.

The platform body 10 has a cylindrical shape that is extended vertically above and below the sea level. In such a case, the platform body 10 can have a cross section of a circular shape or a polygonal shape. Various kinds of equipment required for the drilling or production can be embarked on an upper side of the platform body 10.

A center of buoyancy of the floating offshore structure 1 including the above-described platform body 10 is lower than a center of mass of the floating offshore structure 1. In such a case, if the cross section of the platform body 10 has a circular shape, the diameter (D) of the cross section is greater than the depth (T) of submergence. If the cross section of the platform body 10 has a polygonal shape, the distance from the center of the cross section to a comer is greater than the depth of submergence.

Referring to FIGS. 1 and 2, the platform body 10 has a double floor and a double side wall. Such double floor and double side wall prevent a cargo inside the platform body 10 from leaking out in case the platform body 10 is damaged from the outside. A space defined by the double floor and the double side wall is used as a ballast tank.

In the present embodiment, the platform body 10 includes a plurality of ballast tanks 16 that are radially arranged. Each ballast tank 16 is formed along a side and a bottom of the platform body 10.

In the present embodiment, the platform body 10 includes a plurality of cargo tanks 18 that are radially arranged. In the cargo tank 18, cargos such as oil and natural gas, which are produced by the production equipment embarked on the upper side of the platform body 10, are stored.

Referring to FIG. 3, the platform body 10 is formed with a concave part 12. Accordingly, the platform body 10, which has a tendency of maintaining a constant cross-sectional area along its vertical direction, has a reduced cross-sectional area where the concave part 12 is formed.

The following equation expresses a relation between a water plane area and a natural period (T) of heaving of a typical cylinder.

$$T = 2\pi \Big/ \sqrt{\frac{C}{m_v}} \quad \text{where } C = \rho g A_w,\ m_v = (M + M_a) \tag{1}$$

($\rho$: density of water; g: gravitational acceleration; $A_w$: water plane area; M: mass of cylinder; $M_g$: additional mass in water)

As it can be inferred in the above equation (1), the natural period of heaving of a cylinder is inversely proportional to the water plane area of the cylinder. Here, the water plane area is an area of a cross section of the cylinder at which the water line is located.

Therefore, the natural period of heaving of the platform body 10 is greater when the water line is located at the III-III section of FIG. 1 where the concave part 12 is formed than when the water line is located at the II-II section of FIG. 1 where the concave part 12 is not formed. The same result is demonstrated in the floating offshore structure 1 including the platform body 10.

For instance, in case the water line is located at the II-II section of FIG. 1, the floating offshore structure 1 can have a same or similar natural period as an extreme wave generated in an extreme marine condition.

Here, an extreme marine condition refers to a condition in which an extreme wave that occurs once every 100 years, 1,000 years or 10,000 years statistically is generated in the sea where the floating offshore structure floats.

In such a case, by adjusting the depth of submergence of the platform body 10 such that the water line is located at the III-III section of FIG. 1 where the concave part 12 is formed, the natural period of heaving of the floating offshore structure 1 including the platform body 10 is increased, making it possible to avoid vertical resonance caused by an extreme wave.

Here, it is required that the area of the cross section where the concave part 12 is formed be sufficiently reduced, compared to the area of the cross section where the concave part 12 is not formed, to avoid vertical resonance caused by an extreme wave.

In the present embodiment, the concave part 12 is discontinuously formed along an external circumferential surface of the platform body 10. On the external circumferential surface of the platform body 10 where the concave part 12 is formed, a convex part 14, which is defined by adjacent concave parts 12, is formed.

In the present embodiment, the concave part 12 and the convex part 14 are formed in each ballast tank 16. In such a case, as it can be seen in FIG. 1, each ballast tank 16 has a space that is bent by the concave part 12. Also, as it can be seen in FIG. 4, each ballast tank 16 has a space (S) that connects an upper part and a lower part of the ballast tank 16 in a straight line by the convex part 14.

According to the SOLAS Convention (International Convention for the Safety of Life at Sea), it is required that a ballast tank has a space that connects an upper part and a lower part of the tank in order to save a life. For this, each ballast tank 16 of the present embodiment is formed with the convex part 14, and each ballast tank 16 is formed with a space(s) that connects the upper part and the lower part in a straight line.

Moreover, the space connecting the upper part and the lower part of each ballast tank 16 in a straight line by the convex part 14 can be used as a path for transporting various pipes required for securing the stability of a riser and a tank.

The convex part 14 described above can be successively arranged with an adjacent ballast tank 16, as it can be seen in FIG. 2.

Referring to FIG. 1, in the present embodiment, the platform body 10 is formed with a center part 20 that is vertically extended in the platform body 10. In such a center part 20, machinery equipment and pipe lines that are required for operation of the floating offshore structure 1 are arranged. It is also possible that the center part 20 is used as a moon pool for accommodating the riser or other equipment used for drilling.

In a lower portion of the center part 20, a machine room 22 is arranged. Arranged in the machine room 22 are a ballast pump 26 for pumping the water in the ballast tank 16 and a cargo pump 28 for pumping cargo material in the cargo tank 18.

This arrangement can maximize the utilization of space because the length of pipes for connecting each pump 26, 28 to each tank 16, 18 can be minimized.

In such a case, it is not required that the number of ballast pumps 26 be equal to the number of ballast tanks 16, and it is sufficient to have a proper number of ballast pumps 26 for pumping the water from the ballast tank 16.

Likewise, it is not required that the number of cargo pumps 28 be equal to the number of cargo tanks 18, and it is sufficient to have a proper number of cargo pumps 28 for pumping the cargo material from the cargo tank 18.

Figure 5:
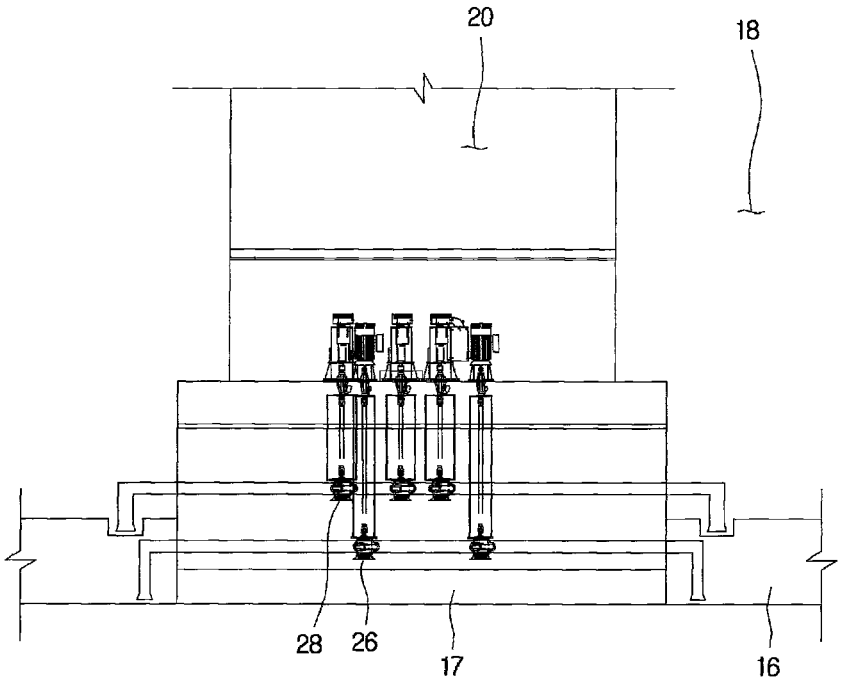
FIG. 5 shows a lower portion of a center part of a platform body included in the floating offshore structure in accordance with an embodiment of the present invention.

FIG. 5 shows the lower portion of the center part of the platform body included in the floating offshore structure in accordance with an embodiment of the present invention. Referring to FIG. 5, in the present embodiment, a step height is formed between a lower ballast tank 17, which is located on a lower side of the machine room 22, and the ballast tanks 16 arranged around the lower ballast tank 17.

In general, the capacity of a pump is determined by the flow rate and water head. Such a step height allows the ballast pump 26 and cargo pump 28 arranged inside the machine room 22 to be adjacent to a bottom floor of the ballast tank 16 and a bottom floor of the cargo tank 18, thereby lowering the water head. Therefore, the capacities of the ballast pump 26 and the cargo pump 28 can be minimized.

Referring to FIG. 1, the platform body 10 of the present embodiment includes an expanded part 19, which is formed to increase a cross-sectional area from a load line of the floating offshore structure 1 to an upper end of the platform body 10. In such a case, the expanded part 19 forms an acute angle, preferably 30 degrees, with a center line of the platform body 10.

Accordingly, the upper end of the platform body 10 has a wider cross-sectional area than a portion below the load line of the platform body 10, and an installation area of the equipment 2 embarked above the platform body 10 can be maximized. In such a case, the upper end of the platform body 10 can be formed in a circular or polygonal shape for the convenience of installation of the embarked equipment.

Hereinafter, the steps for avoiding vertical resonance caused by extreme waves when the floating offshore structure in accordance with the present embodiment is in an extreme marine condition will be described with reference to FIG. 1.

The following description will assume that the natural periods of heaving of the floating offshore structure 1 are 18 seconds and 20 seconds when the water line is respectively located at the II-II section (see FIG. 1) and the III-III section (see FIG. 1) of the platform body 10.

In addition, it will be assumed that in the area where the floating offshore structure 1 floats, the waves have the period of 16 seconds in a general marine condition and the period of 18 seconds in an extreme marine condition.

First, when the water line is located at the II-II section (see FIG. 1) of the platform body 10 and the floating offshore structure 1 is floating in a general marine condition, the natural period of heaving of the floating offshore structure 1 is 18 seconds, and the period of the waves is 16 seconds. Accordingly, no vertical resonance occurs in the floating offshore structure 1.

Later, if the marine condition of the area where the floating offshore structure 1 floats is worsened to an extreme marine condition and the water line is maintained at the II-II section (see FIG. 1) of the platform body 10, the natural period of heaving of the floating offshore structure 1 and the period of the extreme waves coincide to be 18 seconds, and it becomes possible that vertical resonance occurs in the floating offshore structure 1.

To avoid such vertical resonance, the depth of submergence of the floating offshore structure 1 is adjusted prior to the extreme marine condition so that the water line is located at the III-III section (see FIG. 1).

In such a case, since the cross-sectional area of the III-III section, where the concave part is formed, is smaller than that of the II-II section, the natural period of heaving of the floating offshore structure 1 is increased from 18 seconds to 20 seconds, which becomes different from the 18-second period of the extreme waves. Therefore, no vertical resonance occurs in the floating offshore structure 1.

Hitherto, a certain embodiment of the present invention has been described, but the technical ideas of the present invention are not restricted to the embodiment described herein, and it shall be appreciated that anyone of ordinary skill in the art to which the present invention pertains can propose another embodiment by supplementing, modifying, deleting and adding an element within the same technical ideas, but this shall also belong to the technical ideas of the present invention.

What is claimed is:

1. A floating offshore structure used for drilling or production, the floating offshore structure comprising a semi-submerged platform body in a cylindrical shape that is extended vertically above and below a sea level, comprising:

an upper cylindrical portion;

a lower cylindrical portion; and a middle portion disposed between the upper and lower cylindrical portions and extending from the upper cylindrical portion to the lower cylindrical portion, the middle portion comprising a plurality of receded parts and a plurality of protruding parts alternately arranged around a central axis of the middle portion such that each receded part is disposed between two of the protruding parts, wherein the receded parts each include an outer end surface, and the protruding parts each include an outer end surface and two side surfaces, the side surfaces extending from the outer end surface of the protruding part toward the central axis of the middle portion and being connected to the outer end surface of the receded part, the outer end surfaces and the side surfaces of the protruding parts and the outer end surfaces of the receded parts jointly define an outer circumferential surface of the middle portion, the outer end surfaces of the receded parts are closer to the central axis than the outer end surfaces of the protruding parts, a distance of the outer end surfaces of the protruding parts from the central axis is equal to a radius of the upper and lower cylindrical portions.

2. The floating offshore structure of claim 1, wherein:

the platform body comprises a plurality of ballast tanks radially disposed on a side and a bottom of the platform body;

the receded part and the protruding part are formed on each ballast tank; and the each ballast tank has a space that can connect an upper part and a lower part of the ballast tank in a straight line by way of the protruding part.

3. The floating offshore structure of claim 2, wherein the protruding part is successively disposed with the ballast tank that is adjacent to the protruding part.

4. The floating offshore structure of claim 2, wherein:

the platform body comprises a plurality of cargo tanks, the cargo tanks being radially disposed;

a center part is formed in the platform body, the center part being vertically extended; and a ballast pump for pumping water inside the ballast tank and a cargo pump for pumping cargo material inside the cargo tank are disposed in a lower portion of the center part.

5. The floating offshore structure of claim 1, wherein the platform body comprises an expanded part formed to increase a cross-sectional area from a load line of the floating offshore structure to an upper end of the platform body.

6. The floating offshore structure of claim 5, wherein the expanded part forms an angle of 30 degrees with a center line of the platform body.

7. The floating offshore structure of claim 3, wherein:

the platform body comprises a plurality of cargo tanks, the cargo tanks being radially disposed;

a center part is formed in the platform body, the center part being vertically extended; and a ballast pump for pumping water inside the ballast tank and a cargo pump for pumping cargo material inside the cargo tank are disposed in a lower portion of the center part.

8. The floating offshore structure of claim 1, wherein an angle between the side surfaces and the outer end surface of each protruding part is an obtuse angle.

* * * * *